United States Patent [19]

Tseng et al.

[11] Patent Number: 4,881,154

[45] Date of Patent: Nov. 14, 1989

[54] ILLUMINATING UMBRELLA HANDLE

[76] Inventors: Su Tseng, No. 6, Niu Pu Road; Wan S. Chien, No. 25-1, Chung Hsiao Road, both of Hsinchu City, Taiwan

[21] Appl. No.: 194,958

[22] Filed: May 17, 1988

[51] Int. Cl.[4] ..... A45B 3/02; A63B 15/02

[52] U.S. Cl. ..... 362/102; 362/802

[58] Field of Search ..... 362/102, 109, 802; 135/16, DIG. 10

[56] References Cited

U.S. PATENT DOCUMENTS

| | | | |
|---|---|---|---|
| 1,128,167 | 2/1915 | Marson | 362/102 X |
| 1,720,228 | 7/1929 | Malum | 362/102 X |
| 2,246,836 | 6/1941 | Campbell | 135/DIG. 10 X |
| 2,734,124 | 2/1956 | Funk | 362/102 |
| 3,281,586 | 10/1966 | Gonzalez | 362/102 |
| 4,031,381 | 6/1977 | Carver | 135/DIG.10 X |

*Primary Examiner*—Stephen F. Husar
*Assistant Examiner*—Peggy Neils
*Attorney, Agent, or Firm*—Morton J. Rosenberg; Klein David I.

[57] ABSTRACT

An umbrella handle with a pivotable torch, in which two dry batteries are received on both sides of the umbrella shift. The wiring of the handle is such that when the torch is turned over a specific angle, it is switched on. This structure optimally utilize the available space and minimize the size of the handle.

1 Claim, 4 Drawing Sheets

ILLUMINATING UMBRELLA HANDLE

The present invention relates to an illuminating umbrella handle which is provided with a pivotable torch and which is reasonably designed to minimize the size of the handle.

Walking a unilluminated place in rainy night is a troublesome job. One has to use a hand to hold an umbrella and use the other hand to take a torch to light his way. As a result, one has no free hand to carry other articles. On difficult trails where one has to use one hand to grasp the branches, twigs, vines or a bundle of grass to help balance one's weight to avoid slipping down on the slippery path, one had no free hand to take both of the unbrella and the torch.

Therefore, there were umbrellas on which there are provided an illuminating means so that the user need not use the other hand to take a torch when walking in an unilluminated rainy night.

However, these prior art illuminating umbrellas have not been found to be altogether satisfacotry. Initially, the illuminating means of such prior art umbrellas are generally fixed on the handle and cannot provide for relative motion with respect to the main body of the umbrella, thus the light may not be focused or spotlighted into desired volumes or points. Though there are a few prior art umbrellas wherein the illuminating means are adapted for relative motion to the umbrella, none of them are provided with optimized design to provide a small volume which may be grasped in one hand of the user. With such lighting mechanisms and the associated electrical batteries to energize the lighting mechanisms, the handles are inconveniently bulky and aesthetically unbalanced.

Accordingly, it is the object of the subject invention concept to prvoide an illuminating handle for an umbrella which has an optimized structure which obviates the inconvenience and unsightliness of the conventional illuminating handles shown in the prior art.

According to a feature of this invention, the handle is substantially a flat rectangular body, in which two elongate spaces are provided along both sides of the sahft of the umbrella to receive the dry batteries. The illuminating means is pivoted at the lower end near one side of the handle, so that it is pivotable in the flat plane of the handle. The length of the illuminating means approximately corresponds to the width of the handle. The thickness of the illuminating means approximately corresponds to the thickness of the handle. Thus when the torch is folded up, it fits snugly on the lower end of the handle and visually becomes an integral part of the handle.

To enable the batteries to be replaced, the handle is divided into an interval part (battery receiver) in which the umbrella shaft is fixed and the batteries are loaded, and an external part (housing), which can be dismounted to enable the user to replace the batteries.

Preferably, the illuminating is electrically so designed, tht when it is folded up in its horizontal position (here the "horizontal position" means that the illuminating means is folded up so that it fits snugly on the lower end of the handle) it is in OFF state, and when pivoted a small angle away from this position, it is in ON state.

This invention will be better understood when read in connection with the accompanying drawing, in which:

DETAILED DESCRIPTION OF PREFERRED EMBODIMENT

Figure 1:
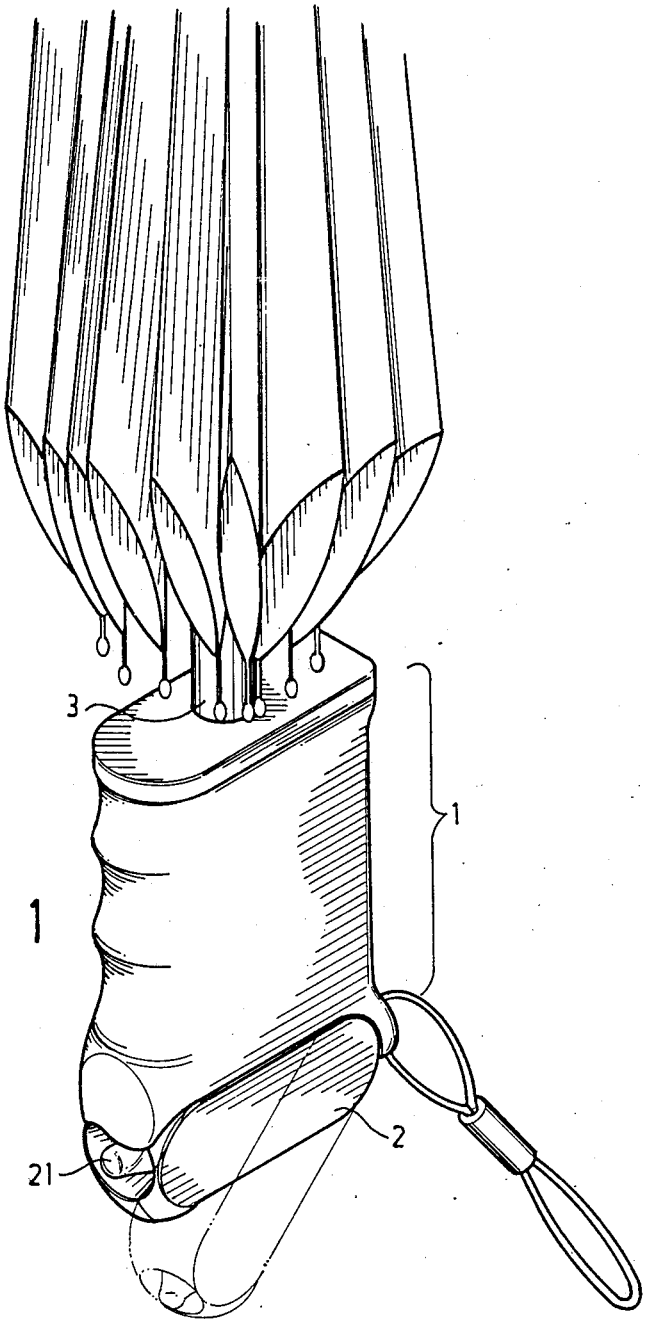
FIG. 1 is a perspective view of an umbrella provided with the illuminating handle of this invention.

Referring to FIG. 1, the umbrella is provided with a handle 1 according to this invention. The handle 1 is substantially a flat rectangular body. An illuminating means 2 is pivotally mounted it lower end and can swing in a plane corresponding to the flat side of the handle.

Figure 3B:
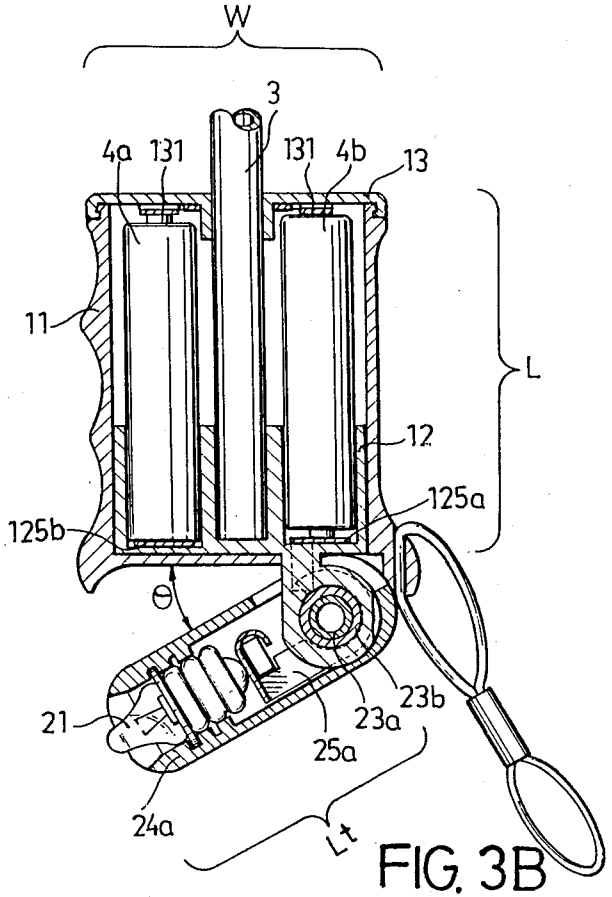
FIG. 3B is a sectional view along the width direction of the umbrella handle, wherein the torch is swung an small angle to ON position.
Figure 3A:
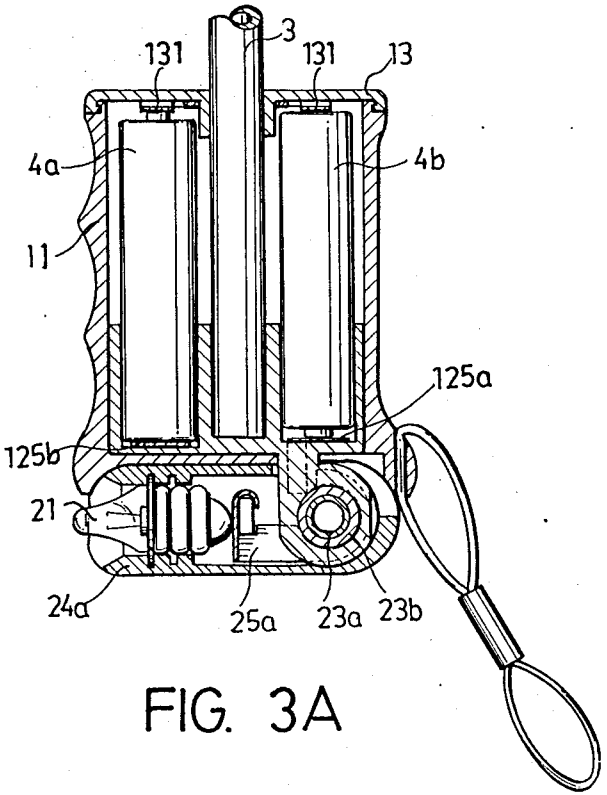
FIG. 3A is a sectional view along the width direction of the umbrella handle, wherein the illuminating means is in OFF position.
Figure 4:
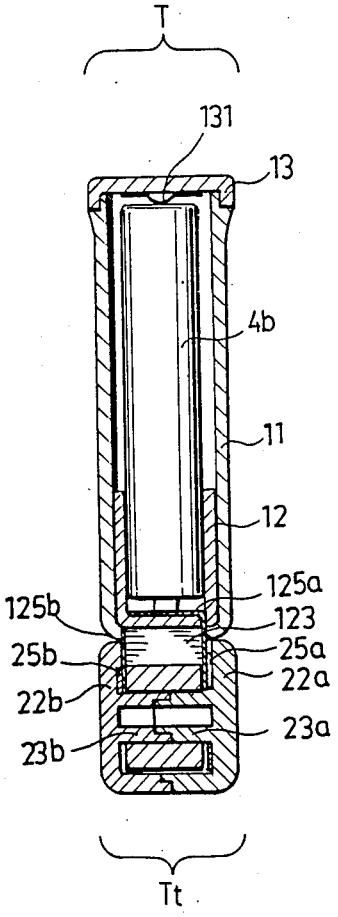
FIG. 4 is a sectional view along the thickness direction of the handle.

Referring to FIG. 3A and FIG. 4, the two batteries 4*a*, 4*b* are loaded on both sides of the shaft 3 of the umbrella. The length of the illuminating means 2 Lt approximately corresponds to the width W of the handle 1, (FIG. 3A) while the thickness of the illuminating means 2 Lt approximately corresponds to the thickness T of the handle 1. Thus when the torch 2 is folded up, it forms a rectangular body together with the handle 1. The length L of the handle 1 slightly outsize the length of the standard dry battery. The rectangular space occupied by the handle 1 and the illuminating means 2 is optimally exploited. Thus the size of the resulting handle is minimized and restricted in a rectangular space of approximately the volume of $L \times W \times T$, and the entity appears to be a rectangular body without any unsightly protruding portions. The illuminating means 2 has a bulb 21 which is in electrical connection with the two batteries 4. When the illuminating means 2 is swung an angle A to be position in FIG. 3B (or over this angle), it is turned on.

Figure 2:
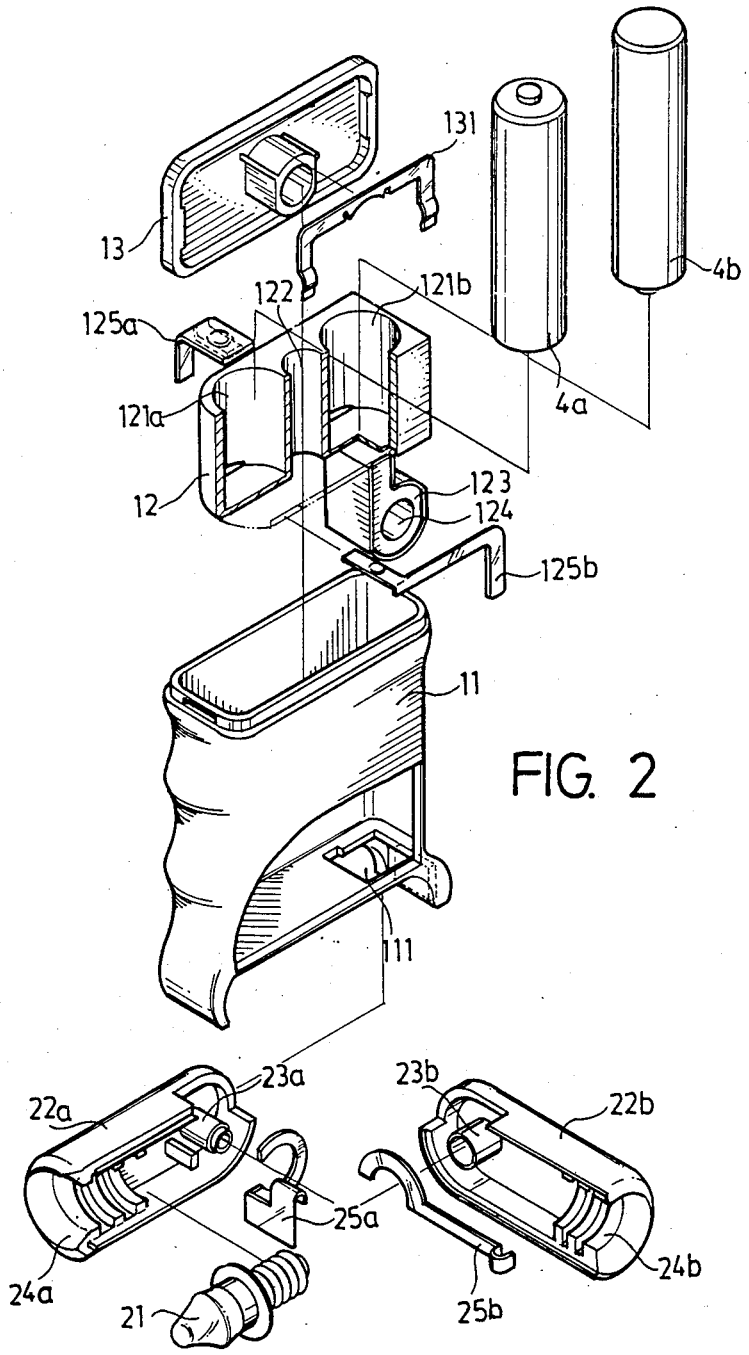
FIG. 2 is a fragmentary view of an embodiment according to the invention.

Referring to FIG. 2, the handle comprises an internal part in form of a battery receiver 12 and a external part in form of a housing 11. The battery receiver 12 has two battery chambers 121a and 121*b* for batteries 4*a*, 4*b* and a shaft bore 122 to receive shaft 3. A cover 13 is fixed on shaft 3. The battery reciver 12 has a pivot seat 123 which has a hole 124. The housing 11 has a slot 111. When battery receiver 12 is received in housing 11, the pivot seat 123 will emerge from the housing 11 through the slot 111.

Illuminating means 2 comprises two split-shells 22*a*, 22*b*, which are provided with engageable pivot member 23*a*, 23*b*, and internal thread 24*a*, 24*b*.

When assembling the handle, firstly load batteries 4*a*, 4*b* in the bttery chamber 121a, 121*b*, then insert the battery receiver into housing 11, with the pivot seat 123 emerging out therefrom. Then mount the two split-shells 22*a*, 22*b* pivotally onto the pivot seat 123 by inserting their pivot members 23*a*, 24*b* into hole 124 from different sides and join them together in the hole 124. Then screw the bulb 21 into the threads 24*a*, 24*b* of the resulting complete shell. Finally insert the shaft 3 (with the cover 13 fixed thereon) into the shaft bore 122.

A plurality of terminals 131, 125, 126, 25*a*, 25*b* are provided to serve for the conduction of the electricity from batteries 4a, 4b to the bulb 21, wherein terminal 131 is fixed on cover 13, terminals 125, 126 are fixed in battery receiver 12 and terminals 25a, 25b are fixed respectively in split-shells 22a and 22b. The design of these terminals are not the characteristic feature of this invention, and can be easily achieved by one skilled in this art, given the concept of this invention. Thus, the details of these terminals can be omitted. It is only to be noted, that these terminal must be such that when the torch is turned over a critical angle theta, the whole circuit is conducted and the bulb is energized. In this embodiment, terminal 25b is "normal close". In other words, terminal 24b is always in electrical contact with bulb 21, whereas terminal 25a is only in electrical connection with bulb 21 when the illuminating means 2 is turned over the specific angle theta.

To replace consumed batteries, firstly remove the shaft 3 (with the cover 13) from the remaining part of the handle 1. Then the batteries can be poured out from the handle 1 and new batteries can be inserted therein from above. In this procedure, one need not separate the battery receiver 12 from the housing.

I claim:

1. An umbrella handle for an umbrella having a shaft which is mounted on said handle, said handle being in form of a substantially rectangular hollow body of length L, width W and thickness T, wherein L slightly outsizes the length of a standard dry battery, said handle being provided with an illuminating means pivotable in a plane perpendicular to the direction of the thickness of said handle, the length of said illuminating means being not greater than W, and the thickness of said illuminating means being not greater than T, said handle being so structured as to receive said shaft while defining two spaces one on each side of said shaft sufficient to respectively receive a standard dry battery, said handle being provided with terminal means which are so structured that said lighting means is only energized when batteries are loaded in said spaces and when said illuminating means is pivoted a specific angle away from said handle.

* * * * *